US010557399B2

(12) United States Patent
Steiner et al.

(10) Patent No.: US 10,557,399 B2
(45) Date of Patent: Feb. 11, 2020

(54) METHODS AND SYSTEMS FOR A VENTILATING ARRANGEMENT

(71) Applicant: Ford Global Technologies, LLC, Dearborn, MI (US)

(72) Inventors: Bernd Steiner, Bergisch Gladbach (DE); Hans Guenter Quix, Herzogenrath (DE); Carsten Weber, Leverkusen (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 35 days.

(21) Appl. No.: 15/956,620

(22) Filed: Apr. 18, 2018

(65) Prior Publication Data

US 2018/0328260 A1 Nov. 15, 2018

(30) Foreign Application Priority Data

May 12, 2017 (DE) ..... 10 2017 208 034

(51) Int. Cl.

| | |
|---|---|
| ***F01P 3/18*** | (2006.01) |
| ***F01P 11/02*** | (2006.01) |
| ***F01P 5/10*** | (2006.01) |
| ***F02B 75/22*** | (2006.01) |
| ***F02M 35/10*** | (2006.01) |
| *F01P 5/06* | (2006.01) |
| *F02F 7/00* | (2006.01) |

(52) U.S. Cl.

CPC ..... *F01P 3/18* (2013.01); *F01P 5/10* (2013.01); *F01P 11/029* (2013.01); *F01P 11/0285* (2013.01); *F02B 75/22* (2013.01); *F02M 35/10268* (2013.01); *F01P 5/06* (2013.01); *F01P 2060/12* (2013.01); *F02F 2007/0063* (2013.01)

(58) Field of Classification Search

CPC .. F01P 3/18; F01P 5/10; F01P 11/0285; F01P 5/06; F01P 2060/12; F01P 11/029; F02B 75/22; F02M 35/10268; B01D 19/0042

See application file for complete search history.

(56) References Cited

U.S. PATENT DOCUMENTS

| | | | |
|---|---|---|---|
| 4,723,596 | A | 2/1988 | Spindelboeck et al. |
| 5,329,889 | A | 7/1994 | Caldwell |
| 6,123,144 | A | 9/2000 | Morman et al. |
| 6,216,646 | B1 | 4/2001 | Smith et al. |
| 7,143,736 | B2 | 12/2006 | Jessberger et al. |
| 7,249,578 | B2 | 7/2007 | Fricke et al. |
| 7,261,069 | B2 | 8/2007 | Gunther |
| 8,074,614 | B2 | 12/2011 | Marriott et al. |

(Continued)

FOREIGN PATENT DOCUMENTS

| | | | |
|---|---|---|---|
| DE | 102004048867 | A1 | 4/2006 |
| DE | 102005020268 | A1 | 11/2006 |

(Continued)

*Primary Examiner* — Syed O Hasan

(74) *Attorney, Agent, or Firm* — Geoffrey Brumbaugh; McCoy Russell LLP

(57) ABSTRACT

Methods and systems are provided for a ventilation arrangement. In one example, a system may include a compact ventilation arrangement arranged within a space between an intake manifold and a cylinder head. A pump of the ventilation arrangement arrange adjacent the cylinder head.

19 Claims, 3 Drawing Sheets

(56) References Cited

U.S. PATENT DOCUMENTS

| | | | | |
|---|---|---|---|---|
| 9,802,472 | B2 * | 10/2017 | Nakamura | B60K 11/04 |
| 2002/0023731 | A1 | 2/2002 | Hirano et al. | |
| 2012/0312257 | A1 | 12/2012 | Beyer et al. | |
| 2013/0036734 | A1 * | 2/2013 | Brinkmann | F01P 3/12<br>60/605.3 |
| 2016/0208675 | A1 * | 7/2016 | Prabhakaran | F01P 7/162 |

FOREIGN PATENT DOCUMENTS

| | | | |
|---|---|---|---|
| DE | 102010009578 | A1 | 9/2011 |
| DE | 102011018170 | A1 | 10/2012 |

* cited by examiner

METHODS AND SYSTEMS FOR A VENTILATING ARRANGEMENT

CROSS REFERENCE TO RELATED APPLICATION

The present application claims priority to German Patent Application No. 102017208034.5, filed May 12, 2017. The entire contents of the above-referenced application are hereby incorporated by reference in its entirety for all purposes.

FIELD

The present description relates generally to a ventilating arrangement close-coupled to a cylinder head.

BACKGROUND/SUMMARY

Individual cylinders of an internal combustion engine may include at least one cylinder head and at least one cylinder block. The cylinder block may comprise a number of cylinder bores equal to a number of pistons arranged in the cylinders. The pistons may be guided through the bores in an oscillating motion, the pistons combined with cylinder walls may form combustion chambers of the internal combustion engine.

The cylinder head comprise one or more valves configured to adjust charge exchange. During the charge exchange, the discharge of the combustion gases via the exhaust-gas discharge system may take place via at least one outlet opening, and a feed of fresh air via an intake system may take place via at least one inlet opening of the cylinder. Parts of the intake system and/or of the exhaust-gas discharge system may be integrated in the cylinder head.

Thermal loading of the internal combustion engine may be maintained within a desired operating range via a cooling arrangement arranged within spaces of the internal combustion engine. The cooling arrangement may be a liquid or air type cooling arrangement. Herein, the present disclosure may specifically refer to a liquid-type cooling arrangement, however, it will be appreciated by those of ordinary skill in the art that the disclosure may additionally apply to an air-type cooling arrangement.

In some examples, the cooling arrangement may be arranged as a coolant jacket adjacent to cylinder walls of the combustion chamber. The heat may be dissipated to the coolant, which may be water, optionally mixed with additives, present in the coolant jacket of the cylinder head or block. The coolant may be conveyed, such that it circulates, via a pump which may arranged in the cooling circuit and which may be mechanically driven via a traction mechanism drive. The heat dissipated to the coolant is discharged from the interior of the cylinder head or block in this way, and may be extracted from the coolant again in a heat exchanger. A ventilation vessel provided in the cooling circuit may function for ventilating the coolant or the circuit.

Air may enter the cooling circuit from the outside. For example, air may undesirably enter the cooling circuit during a filling of the cooling circuit with coolant or admixing of additives to lower the freezing point of the coolant, which may be performed to allow the internal combustion engine to be more suitable for winter operation. Air may however also ingress in the case of unsealed cooling circuits, for example in the case of porous coolant hoses. Air in the coolant circuit may degrade the engine due to air bubbles forming in the coolant pump, resulting in the coolant pump pumping air and not coolant. By doing this, the coolant may no longer be sufficiently cooled and the internal combustion engine may be thermally overloaded (e.g., operating at a temperature greater than the desired temperature range).

Additionally, air may not absorb heat as well as liquid coolant and may form a barrier between the coolant and coolant jacket surfaces, mitigating heat transfer from the cylinder head and/or block to the coolant jacket. The barrier of air may create localized maxima and/or hotspots, which may also lead to degradation (e.g., cracking).

For the above-described reasons, a ventilation system, such as a degas bottle, may be arranged in the cooling arrangement to remove air trapped in the cooling circuit along with coolant vapor bubbles formed therein. The ventilation system may be strategically arranged such that conditions of the coolant circuit may self-regulate coolant flow therethrough, wherein the self-regulation may be temperature based.

The ventilation system may be arranged at a geodetically highest point of the cooling arrangement, whereby the discharge of air and vapor bubbles may occur via buoyant forces that act on the gas bubbles and drive the gases situated in the circuit upward and through the ventilation system. The coolant jackets, coolant ducts and/or hoses may, in the arranged position of the internal combustion engine, rise in the direction of the ventilation system, such that the bubbles are led to the ventilation system.

According to the previous examples, a ventilation system, such as the system described above, may be generally arranged on and fastened to a bulkhead, which delimits the engine bay with respect to the passenger compartment, at a distance from the internal combustion engine. This arrangement of the ventilation system demands long coolant hoses, in particular a long ventilation line leading to the ventilation system and a long return line that branches off from the ventilation system. Furthermore, a desired volume of coolant increases, and a weight of the engine cooling arrangement increases with the greater coolant volume. The greater coolant volume also demands a longer warm-up process after a cold start of the internal combustion engine compared to coolant systems with less coolant, which may be decrease fuel economy and increase emissions.

Long coolant hoses or long coolant lines may be associated with bends and curves of said hoses or lines, and furthermore with a low gradient, that is to say a small ascent per unit distance. The latter in particular may decrease ventilation and promote formation of flow dead zones. The costs of the engine cooling arrangement as a whole may increase. Said another way, a greater buoyant force is demanded to act on the gas bubbles when the hoses are longer.

In one example, the issues described above may be addressed by a liquid-cooled internal combustion engine having at least one cylinder head comprising at least one cylinder, an intake system for the supply of air, which intake system comprises an inlet manifold, said inlet manifold laterally adjoining the at least one cylinder head and comprising a plenum chamber, from which at least one cylinder-specific intake line branches off for each cylinder, and a liquid-type cooling arrangement which, to form a cooling circuit, is equipped with a pump for conveying the coolant and with a ventilation vessel, the ventilation vessel being incorporated into the cooling circuit of the internal combustion engine by means of a ventilation line and a return line, and where internal combustion engine further comprises where the ventilation vessel is arranged above the inlet manifold and between the inlet manifold and the at least one cylinder head, a virtual connecting line between the inlet manifold and the at least one cylinder head intersecting the ventilation vessel. In this way, the compact arrangement of the ventilation vessel may decrease a desired volume of coolant, decrease manufacturing costs, and increase fuel economy.

As one example, the ventilation vessel is arranged in a close-coupled position, specifically above the inlet manifold, between the inlet manifold and the cylinder head. Here, a virtual line that connects the inlet manifold and the cylinder head to one another may intersect the ventilation vessel. The arrangement according to the disclosure of the ventilation vessel may provide a compact design and dense packaging of the drive unit as a whole in the engine bay. The length of the coolant hoses may be reduced relative to the previous examples described above where the ventilation vessel is fastened to the bulkhead. In particular, the ventilation line leading to the vessel and the return line branching off from the vessel may be shortened. In this way, the desired coolant quantity, and with this the weight of the engine cooling arrangement, can be reduced.

The reduced coolant quantity may ensure an accelerated warm-up process during a cold start of the internal combustion engine, and thus a reduction in the friction losses of the internal combustion engine, and decreased emissions during the cold-start.

Shorter coolant hoses or shorter coolant lines may comprise fewer bends and curves. In some cases, the arrangement according to the disclosure of the ventilation vessel may comprise lines integrated into the internal combustion engine, for example into the cylinder head. Additionally or alternatively, external hoses may be omitted from the ventilation vessel. The susceptibility of the engine cooling arrangement to leaks may thereby be decreased. Additionally, the formation or hot spots or local maxima may be mitigated due to the shorter coolant hoses comprising fewer twists and/or bends.

Furthermore, the arrangement according to the disclosure of the ventilation vessel may lead to higher gradients in the cooling circuit, that is to say steeper gradients, whereby ventilation of the engine cooling arrangement may be assisted and/or promoted. Said another way, buoyant forces needed to act on the gas bubbles to remove gas from the coolant arranged in the coolant circuit may be less than the buoyant forces needed in the previous examples described above where the hoses are longer. Furthermore, the costs for the engine cooling arrangement can be reduced.

Embodiments of the liquid-cooled internal combustion engine may comprise where a supercharging arrangement or supercharging device is provided.

Supercharging may increase power in which the air demanded for the combustion process in the engine is compressed, as a result of which a greater charge air mass may be provided to each cylinder in each working cycle. In this way, the fuel mass and therefore the mean pressure can be increased.

Supercharging may increase a power output of an internal combustion engine while maintaining an unchanged swept volume, or for reducing the swept volume while maintaining the same power. At any rate, supercharging may lead to an increase in volumetric power output and a more expedient power-to-weight ratio. If the swept volume is reduced, it is possible, given the same vehicle boundary conditions, to shift the load collective toward higher loads, at which the specific fuel consumption is lower. Supercharging of an internal combustion engine may minimize fuel consumption, that is to say it may increase the efficiency of the internal combustion engine.

In some embodiments, the transmission configuration may provide downspeeding, whereby a lower specific fuel consumption is likewise achieved. In the case of downspeeding, use is made of the fact that the specific fuel consumption at low engine speeds is generally lower, in particular in the presence of relatively high loads.

A supercharged internal combustion engine may be thermally more highly loaded, owing to the increased mean pressure compared to a naturally aspirated engine, and therefore may increase demands on the cooling arrangement, and as a result, supercharged internal combustion engines may desire a liquid-type cooling arrangement.

Here, embodiments of the liquid-cooled internal combustion engine may comprise where the supercharging of the internal combustion engine, at least one exhaust-gas turbocharger is provided in which a compressor and a turbine are arranged on the same shaft.

In an exhaust-gas turbocharger, a compressor and a turbine are arranged on the same shaft. The hot exhaust-gas flow may be fed to and expand in the turbine with a release of energy, as a result of which the shaft is set in rotation. The energy supplied by the exhaust-gas flow to the shaft is used for driving the compressor which is likewise arranged on the shaft. The compressor delivers and compresses the charge air supplied to it, as a result of which supercharging of the at least one cylinder is obtained. A charge-air cooler may be arranged in the intake system downstream of the compressor, where charge-air cooler cools the compressed charge air before it enters the at least one cylinder. The cooler lowers the temperature and thereby increases the density of the charge air, such that the cooler also contributes to improved charging of the cylinders, that is to say to a greater air mass. In effect, compression by cooling may be obtained.

The difference between an exhaust-gas turbocharger in relation to a supercharger, which can be driven by means of an auxiliary drive, consists in that an exhaust-gas turbocharger utilizes the exhaust-gas energy of the hot exhaust gases, whereas a supercharger draws the energy demanded for driving it directly or indirectly from the internal combustion engine and thus adversely affects, that is to say reduces, the efficiency, at least for as long as the drive energy does not originate from an energy recovery source.

If the supercharger is not one that can be driven by means of an electric machine, that is to say electrically, a mechanical or kinematic connection for power transmission may be desired between the supercharger and the internal combustion engine.

A difference between a supercharger and an exhaust-gas turbocharger consists in that the supercharger may generate a demanded boost pressure a greater range of engine conditions, specifically regardless of the operating state of the internal combustion engine, in particular regardless of the present rotational speed of the crankshaft. This applies in particular to a supercharger which can be driven electrically by means of an electric machine.

Embodiments of the liquid-cooled internal combustion engine may comprise at least one supercharger which can be driven via an auxiliary drive.

Embodiments of the liquid-cooled internal combustion engine may comprise an exhaust manifold of the exhaust-gas discharge system integrated into the at least one cylinder head.

As a result of the merging of the exhaust lines within the cylinder head, the overall length of the exhaust lines may decrease, and the line volume of the exhaust manifold is reduced. The merging of the exhaust lines within the cylinder head may allow dense packaging of the drive unit.

Benefits may be achieved in the case of exhaust-gas turbocharging because the turbine can be arranged in a close-coupled position, whereby the exhaust-gas enthalpy of the hot exhaust gases, which may be based on the exhaust-gas pressure and the exhaust-gas temperature, may be utilized optimally, and a fast response behavior of the turbine or of the turbocharger may be more likely. Furthermore, the path of the hot exhaust gases to the different exhaust-gas aftertreatment systems may be short, whereby an exhaust gas temperature may remain relatively unaffected and the exhaust-gas aftertreatment systems reach their operating temperature or light-off temperature quickly, in particular after a cold start of the internal combustion engine.

An internal combustion engine with an integrated exhaust manifold may be subject to high thermal load and may desire the liquid-type cooling arrangement described above.

Embodiments of the liquid-cooled internal combustion engine may comprise where the ventilation vessel is formed at least partially integrally with the inlet manifold.

In particular, embodiments of the liquid-cooled internal combustion engine may comprise where the ventilation vessel is formed in one piece with the inlet manifold.

A ventilation vessel formed at least partially integrally with the inlet manifold may comprise a smaller space demand, which may decrease packaging constraints.

The integral form of the ventilation vessel with the inlet manifold may eliminate the need for other or further fastenings of the ventilation vessel. Thus, manufacturing costs may decrease and manufacturing efficiency may increase, thereby improving manufacturing practices.

Embodiments of the liquid-cooled internal combustion engine may comprise where the ventilation vessel is formed at least partially integrally with a valve cover of the at least one cylinder head. The valve cover may serve as a cover for valve drives arranged in the cylinder head. In some examples, the valve cover is a cam cover.

In some examples, a valve cover, already present on an internal combustion engine, may form at least a portion of the ventilation vessel.

The valve cover may be a plastic part shaped by injection molding into the intake manifold and may be present prior to manufacture of the ventilation vessel. As such, the ventilation vessel may be integrated and/or incorporated into the already present valve cover. Additionally or alternatively, the ventilation vessel may be molded into the intake manifold, separately from the valve cover.

Embodiments of the liquid-cooled internal combustion engine may comprise where the ventilation line is at least partially integrated into the at least one cylinder head.

Embodiments of the liquid-cooled internal combustion engine may comprise where the return line is at least partially integrated into the at least one cylinder head.

The integration of a line into the cylinder head at least partially, or in sections, possibly entirely, eliminates the demand for an external hose. Furthermore, the susceptibility of the line to degrade (e.g., form a crack and/or leak) may decrease.

Embodiments of the liquid-cooled internal combustion engine may comprise where the return line connects the ventilation vessel to the pump.

Embodiments of the liquid-cooled internal combustion engine may comprise where the ventilation vessel is manufactured from plastic. Plastic may comprise a low specific weight, wherein the relatively low thermal load capacity may provide a desired stability and thermal communication therethrough. Good moldability and degrees of freedom with regard to shaping may be additional benefits.

Embodiments of the liquid-cooled internal combustion engine may comprise where the pump may be an electrically operated pump, which is supplied with power for example from an on-board battery, and which can convey coolant even when the internal combustion engine is deactivated. The electrically operated pump may adjust both the coolant pressure and the coolant throughput as desired. Additionally or alternatively, the pump may be a mechanically operated pump and/or traction operated pump. The traction operated pump may be operated by a camshaft of the internal combustion engine via arranging the pump adjacent to the cylinder head or in the cylinder head, and thus also adjacent to the ventilation vessel. A traction mechanism may include a belt, wherein the belt may be a low-friction belt. In some examples, the pump may be fastened at the inlet side to the at least one cylinder head.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2 and 3 are shown approximately to scale.

DETAILED DESCRIPTION

Figure 1:
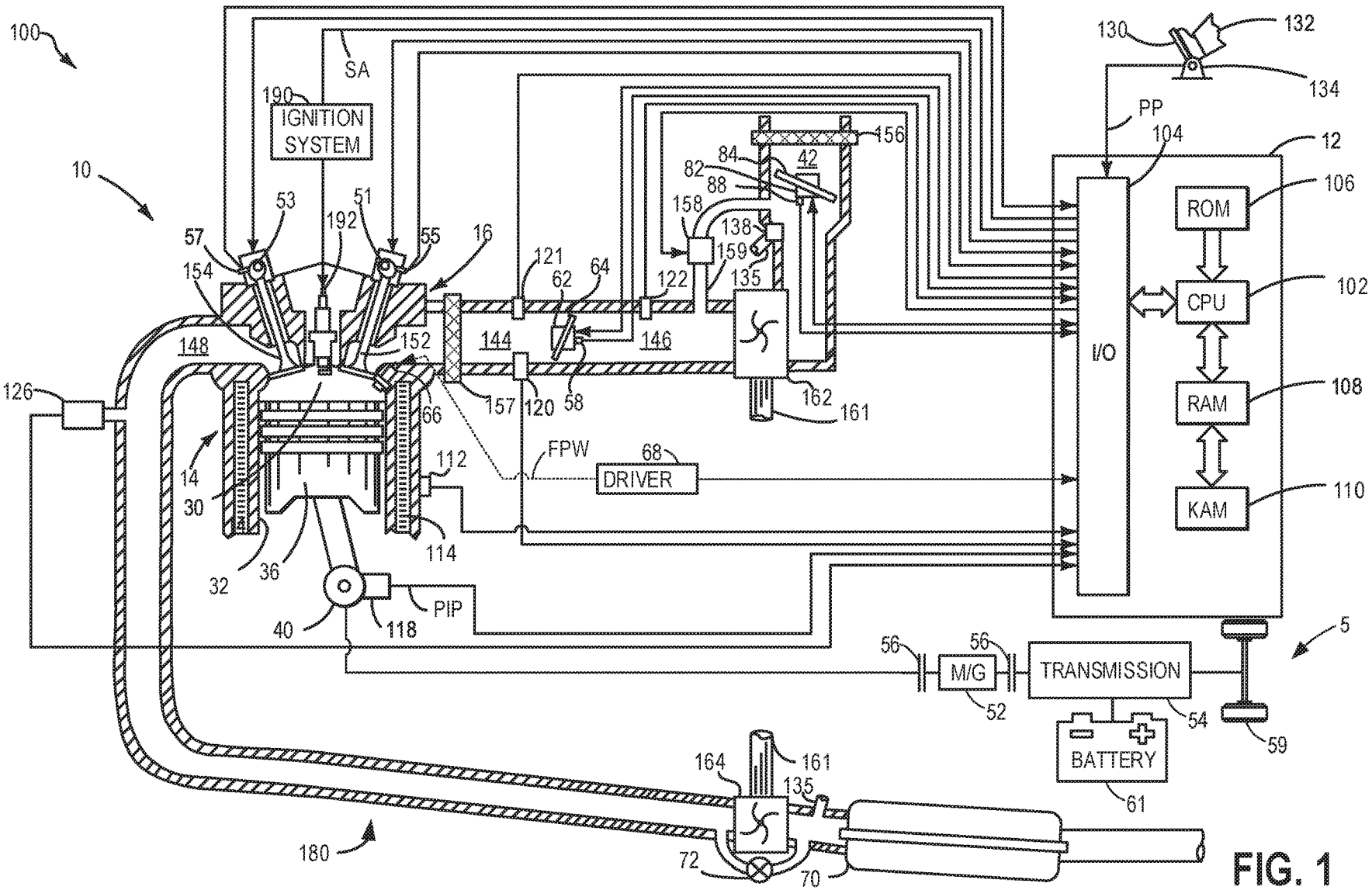
FIG. 1 shows an engine of a hybrid vehicle.
Figure 2:
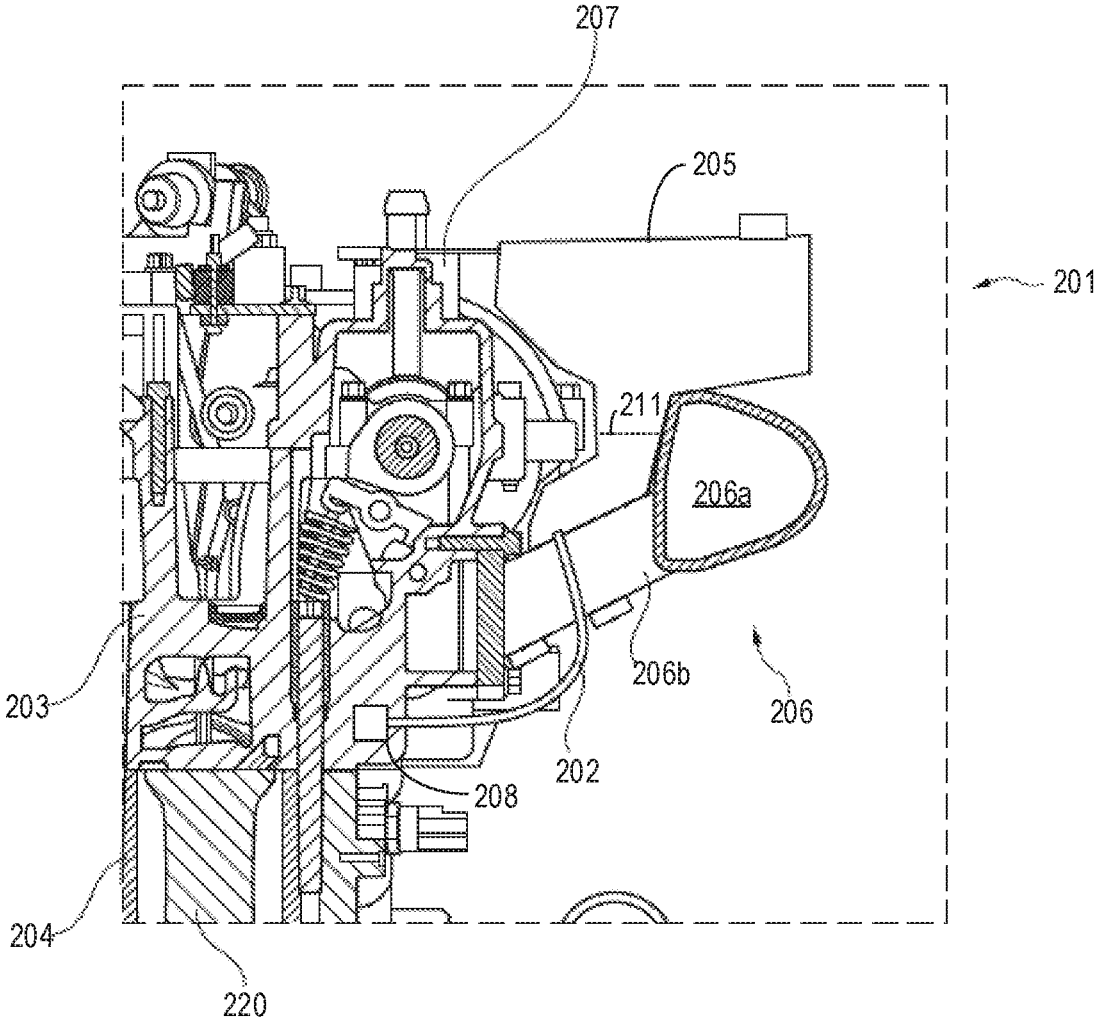
FIG. 2 schematically shows, in a side view and partially in section, a fragment of a first embodiment of the liquid-cooled internal combustion engine together with the ventilation vessel.
Figure 3:
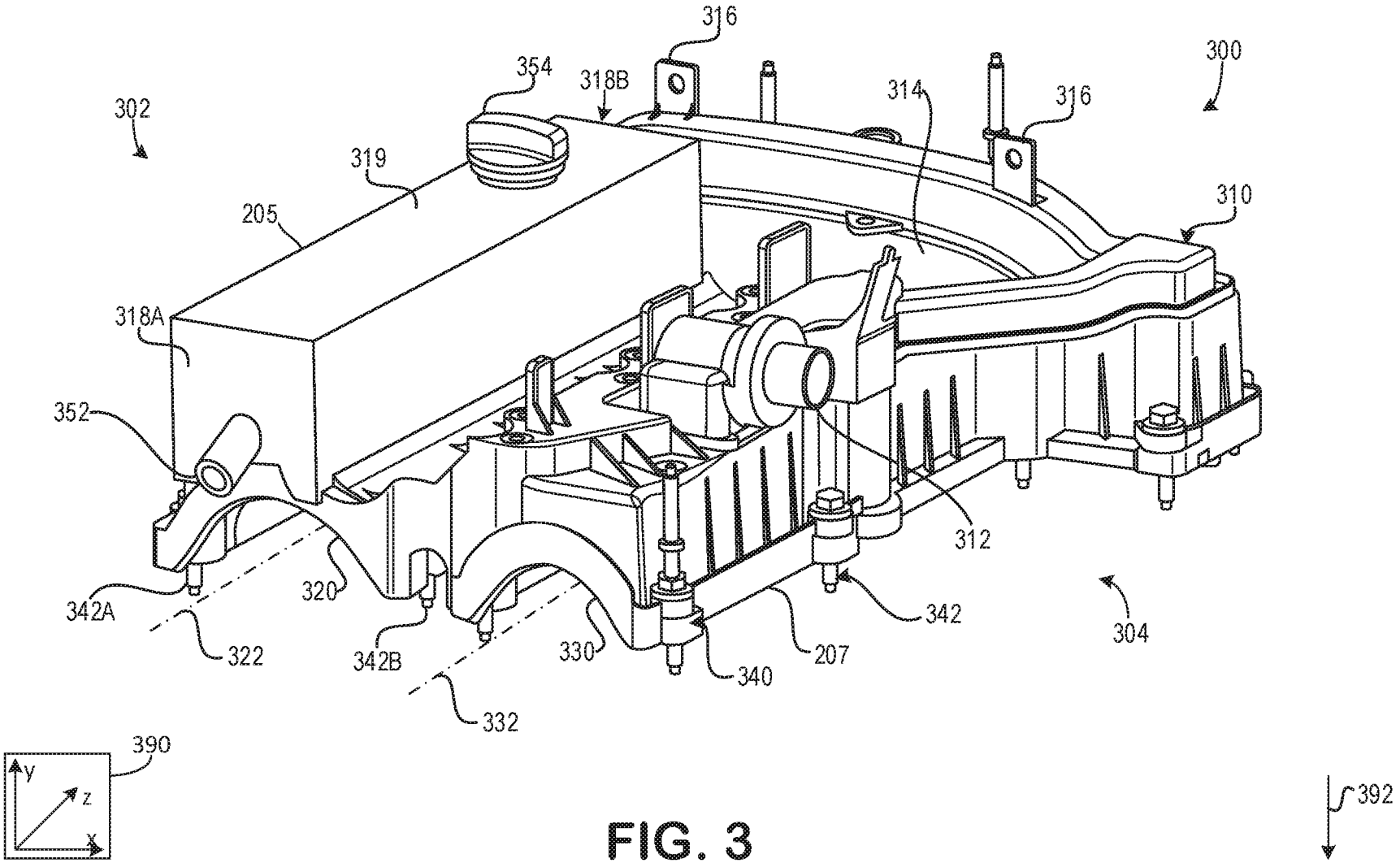
FIG. 3 shows a perspective view of the ventilation vessel.

The following description relates to systems and methods for a ventilation system close-coupled to the engine. More specifically, the ventilation system may be integrated into one or more pre-existing components of the engine. A schematic diagram of the engine is shown in FIG. 1. A detailed depiction of the engine comprising a valve cover and the ventilation system is shown in FIG. 2. Therein, the ventilation system is integrated into the valve cover to decrease packaging restraints of the engine and further allowing one or more passages of the ventilation system to be arranged in a cylinder head. This may decrease a hose length and increase thermal regulation of the engine. FIG. 3 shows a perspective view of the ventilation vessel integrated with a cam cover.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore 20 may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 59.

Electric machine 52 may also be operated as a generator to provide electrical power to charge battery 58, for example during a braking operation.

Turning now to FIG. 2, it schematically shows, in a side view and partially in section, a fragment of a first embodiment of the liquid-cooled internal combustion engine together with the ventilation vessel 205.

The illustration shows a part of a cylinder head 203, which is connected at an assembly end side to a cylinder block 204 in order to form the cylinders 220 of the internal combustion engine.

The cylinder block 204 may serve as a crankcase for accommodating pistons of the cylinders 220. The cylinder head 203 may serve for accommodating the valve drives shaped for the charge exchange, wherein a valve cover 207 serves as a cover for the valve drives. The valve cover 207 may be substantially similar to a cam cover. Herein, valve cover 207 may be interchangeably referred to as cam cover 207.

The valve actuating device of a valve may comprise a camshaft with a cam and at least one cam follower element, which is arranged in the force flow between the camshaft, that is to say the cam, and the associated valve. In the present case, a rocker arm forms the cam follower element. The actuating mechanism, including the valve itself, may be referred to as valve drive. The valve drives may be configured to open up and close the inlet and outlet openings of the cylinders 220 at the desired times, and to ensure charging of the cylinder 220 and a discharge of the combustion gases.

For the supply of air, an intake system 201 is provided, which comprises an inlet manifold 206 which may laterally adjoin the cylinder head 203. The inlet manifold 206 may comprise a plenum chamber 206*a*, from which intake lines 206*b* branch off and lead to the cylinder-specific inlet openings.

To keep the thermal load on the cylinder head 203 within limits and/or a desired thermal range, the internal combustion engine may be equipped with a liquid-type cooling arrangement, such as ventilation vessel 205. In the cylinder head 203, there are provided a coolant jacket and multiple coolant ducts which conduct the coolant through the cylinder head 203. Here, the coolant is conveyed by means of a pump 208 arranged along the cooling circuit, the pump 208 being case arranged on or partially in the cylinder head 203. Pump 208 may illustrate an optional location of the pump 208 in the cylinder head 203. It will be appreciated that the pump 208 may be optionally positioned in different portions of the cylinder head. As described, the pump 208 may be arranged to utilize one or more mechanical elements of the cylinder head 203 to reduce the demand for additional actuating elements, thereby decreasing a packaging restraint.

The ventilation vessel 205 is incorporated into the cooling circuit of the internal combustion a ventilation line and a return line 202, wherein the return line leads from the ventilation vessel 205 to the pump 208. In one example, the ventilation vessel 205 is a degas bottle.

In some examples, additionally or alternatively, the pump 208 may be fastened to an inlet side of the cylinder head 203. At any rate, the return line 202 and/or the ventilation line may be arranged interior to the cylinder head 203. That is to say, the cylinder head 203 may be machined to include passages for fitting the ventilation line and the return line 202. Additionally or alternatively, the ventilation line and/or return line 202 may be fluidly coupled to a coolant jacket (e.g. coolant jacket 114 of FIG. 1) of the cylinders 220.

The ventilation vessel 205 may be arranged between the inlet manifold 206 and the cylinder head 203. A virtual connecting line 211 between the inlet manifold 206 and the cylinder head 203 may intersect the ventilation vessel 205. In some examples, additionally or alternatively, the ventilation vessel 205 may be integrally molded onto the intake manifold 206, such that the wall of the vessel are integral and permanently attached to the cover and the resulting joint does not have a seam.

Turning now to FIG. 3, it shows an embodiment 300 of the ventilation vessel 205 integrated with the cam cover 207. In this example, the ventilation vessel 205 is mounted directly and permanently on an intake side 302 of the cam cover 207. By arranging the ventilation vessel 205 on the cam cover 207, gradients relative to gravity of coolant passages and/or coolant hoses may be increased which may increase a filling performance of the ventilation vessel 205 along with a reduction of air trapped within the ventilation vessel 205 and the coolant passages and/or coolant hoses.

An axis system 390 is shown including three axes, namely an x-axis parallel to a horizontal direction, a y-axis parallel to a vertical direction, and a z-axis perpendicular to each of the x- and y-axes. A direction of gravity is shown via arrow 392 with the cover mounted on an engine of a vehicle on level ground.

A coolant line 310 may be arranged on the cam cover 207. In some examples, the coolant line 310 may extend from a coolant line inlet 312 and follow an outer profile of the cam cover 207. As such, the coolant line 310 may serpentine and/or snake around a perimeter of the cam cover 207. More specifically, the coolant line inlet 312 may be arranged on an exhaust side 304 of the cam cover 207, wherein the coolant line 310 extends from the coolant line inlet 312 around a perimeter ridge 314 of the cam cover 207. The perimeter ridge 314 may be a raised surface of the cam cover 207, wherein the perimeter ridge 314 extends around the cam cover 207 at a location above the intake recess 320 and the exhaust recess 330.

In some examples, the coolant line 310 may comprise a U-shape. The U-shape may be asymmetric in the example of the FIG. 3, where a portion of the coolant line 310 on the exhaust side 304 is longer than a portion of the coolant line 310 on an intake side 302. The coolant line 310 may fluidly couple to the ventilation system 205 on the intake side 302.

The coolant line 310 may further comprise a pair of mounting brackets 316 extending from an outer surface of the coolant line 310 in a direction away from the cam cover 207. The mounting brackets 316 may be shaped to allow fasteners of a separate component to extend therethrough, thereby allow the separate component to physically couple to the coolant line 310.

In this way, the coolant line 310 may receive coolant via the coolant inlet 312 on the exhaust side 304. The coolant inlet 312 may receive coolant from one or more of an EGR cooler, cylinder coolant jacket, turbocharger coolant jacket, or some other coolant line arranged adjacent to the engine and/or exhaust passage. The coolant may flow through the coolant line 310 before reaching the ventilation vessel 205. By extending the coolant line 310 around the perimeter ridge 316 of the cam cover 207, the coolant may warm up more rapidly than an example where the coolant line extends directly from the coolant inlet 312 to the ventilation vessel 205. By doing this, a cold-start duration may be shortened relative to other configurations.

As illustrated, the cam cover 207 further comprises a plurality of bores 340, each bore of the plurality of bores 340 may be shaped to receive one of a plurality of fasteners 342.

The plurality of bores 340 may be arranged around an entire perimeter of the cam cover 207. Additionally, bores 340 may be arranged between the intake cam recess 320 and the exhaust cam recess 330. In one example, each of the bores 340 may be threaded complementary to a threading of each of the fasteners 342. In one example, the fasteners 342 are bolts. The fasteners 342 may extend through one or more bores of a cylinder head (e.g., cylinder head 203 of FIG. 2) to physically couple the cam cover 207 to the cylinder head.

The intake cam recess 320 may be shaped to receive one or more camshafts and/or valves of one or more cylinders of an engine (e.g., engine 10 of FIG. 1). Similarly, the exhaust cam recess 330 may be shaped to receive one or more camshafts and/or valves of one or more cylinders of the engine. In one example, the intake cam recess 320 may receive an intake cam and the exhaust cam recess 330 may receive an exhaust cam. The intake cam recess 320 may comprise a longitudinal axis 322, which may be parallel to a longitudinal axis 332 of the exhaust cam recess 330. Each of the longitudinal axes 322 and 332 may be parallel to camshafts arranged in the intake 320 and exhaust cam recesses, respectively.

In the example of the FIG. 3, the ventilation vessel 205 may be arranged over the intake cam recess 320, wherein a longitudinal length of the ventilation vessel 205 is parallel to the longitudinal axis 322 of the intake cam recess 320. In some examples, the ventilation vessel 205 may only be arranged above the intake cam recess 320. As such, in one example, the ventilation vessel 205 may not be arranged over the exhaust cam recess 330. Said another way, the ventilation vessel 205 may not intersect with a vertical line extending from the exhaust cam cover 330 such that there is no overlap between the ventilation vessel 205 and the exhaust cam recess 330 along the y-axis.

The ventilation vessel 205 may extend along an entire longitudinal length of the intake cam recess 320. A width and/or lateral length of the ventilation vessel 205 may be less than a distance between fasteners 342A and 342B. By doing this, an assembly worker and/or repair person may access each of the fasteners 342 without removing the ventilation vessel 205 from the cam cover 205.

The ventilation vessel 205 may further comprise an outlet 352 extending from a first lateral side 318A of the ventilation vessel 205. The first lateral side 318A may be opposite a second lateral side 318B, wherein the second lateral side 318B may receive the coolant line 310. As such, the outlet 352 may be arranged on an opposite side of the ventilation system 205 than a side receiving the coolant line 310. The outlet 352 may be a coolant outlet, which may direct coolant to another liquid cooled device. Additionally or alternatively, the outlet 352 may be a gas outlet, wherein the ventilation system may degas via the outlet 352.

The ventilation vessel 354 further comprises a fill cap 354 arranged on a top longitudinal surface 319. The top longitudinal surface 319 may be a longitudinal surface furthest from the intake cam recess 320. As such, a bottom longitudinal surface may be in direct face-sharing contact with the cam cover 207. Thus, the top longitudinal surface 319 may face a direction opposite the intake cam recess 320. In this way, the fill cap 354 may be easily accessible by an assembly worker and/or repair person.

In this way, a ventilation system may be molded and/or integrated into one or more preexisting components of an engine. The technical effect of arranging the ventilation system into or adjacent to a preexisting engine component such as a valve cover or intake manifold may be to decrease hose lines of the ventilation system to decrease a coolant volume demand and hose length. By doing this, coolant may warm-up more rapidly compared to ventilation systems with longer hose lines, thereby decreasing a cold-start duration. Additionally, the shorter hoses may decrease a likelihood of gas being trapped within passages of the ventilation system, which may increase a thermal load of the engine.

An embodiment of a liquid-cooled internal combustion engine comprises at least one cylinder head comprising at least one cylinder, an intake system shaped to supply air, the intake system comprising an inlet manifold laterally adjoining the at least one cylinder head and comprising a plenum chamber, from which at least one cylinder-intake line branches off for each cylinder, and a liquid-type cooling arrangement comprises a cooling circuit equipped with a pump for conveying a coolant and with a ventilation vessel, the ventilation vessel is fluidly coupled to the cooling circuit of the internal combustion engine via a ventilation line and a return line, wherein the ventilation vessel is arranged above the inlet manifold and between the inlet manifold and the at least one cylinder head, a virtual connecting line extending from the inlet manifold and the at least one cylinder head intersects the ventilation vessel. A first example of the liquid-cooled internal combustion engine further comprises where the ventilation vessel is formed at least partially integrally with the inlet manifold. A second example of the liquid-cooled internal combustion engine, optionally including the first example, further comprises where the ventilation vessel is formed in one piece with the inlet manifold. A third example of the liquid-cooled internal combustion engine, optionally including the first and/or second examples, further comprises where the ventilation vessel is formed at least partially integrally with a valve cover of the at least one cylinder head. A fourth example of the liquid-cooled internal combustion engine, optionally including one or more of the first through third examples, further includes where the cooling circuit is at least partially integrated into the at least one cylinder head. A fifth example of the liquid-cooled internal combustion engine, optionally including one or more of the first through fourth examples, further includes where the return line is at least partially integrated into the at least one cylinder head. A sixth example of the liquid-cooled internal combustion engine, optionally including one or more of the first through fifth examples, further includes where the return line connects the ventilation vessel to a pump. A seventh example of the liquid-cooled internal combustion engine, optionally including one or more of the first through sixth examples, further includes where the pump is an electrically operated pump. An eighth example of the liquid-cooled internal combustion engine, optionally including one or more of the first through seventh examples, further includes where the pump is a mechanically operated pump. A ninth example of the liquid-cooled internal combustion engine, optionally including one or more of the first through eighth examples, further includes where the pump is driven via using a traction mechanism comprising a camshaft of the internal combustion engine. A tenth example of the liquid-cooled internal combustion engine, optionally including one or more of the first through ninth examples, further includes where the pump is fastened at an inlet side to the at least one cylinder head adjacent the intake manifold. An eleventh example of the liquid-cooled internal combustion engine, optionally including one or more of the first through tenth examples, further includes where the ventilation vessel comprises a plastic material.

An embodiment of a system comprises an engine comprising a cylinder head physically coupled to a cylinder block, the cylinder head comprising a valve cover coupled thereto, and where a ventilation arrangement is integrated into the valve cover and arranged in a location between the intake manifold and the cylinder head. A first example of the system further includes where the ventilation arrangement comprises a cooling circuit fluidly coupled to at least one coolant jacket of at least one cylinder of the engine. A second example of the system, optionally including the first example, further includes where the cooling circuit extends through the cylinder head. A third example of the system, optionally including the first and/or second examples, further includes where the ventilation system comprises a pump arranged adjacent to the cylinder head. A fourth example of the system, optionally including one or more of the first through third examples, further includes where the pump is arranged interior to the cylinder head. A fifth example of the system, optionally including one or more of the first through fourth examples, further includes where the pump is fastened at an inlet side of the cylinder head. A sixth example of the system, optionally including one or more of the first through fifth examples, further includes where the pump is operated via a camshaft.

An embodiment of an engine comprises at least one cylinder arranged within a cylinder head and a cylinder block, the cylinder comprising a cooling jacket fluidly coupled to a cooling circuit of a ventilation arrangement physically coupled to a valve cover of the cylinder head and arranged in a space between the cylinder head and an intake manifold, and where a pump of the cooling circuit is fastened at an inlet side of the cylinder head.

An additional embodiment of an engine comprises at least one cylinder arranged within a cylinder head and a cylinder block, the cylinder comprising one or more intake valves and exhaust valves, a cam cover comprising an intake cam recess and an exhaust cam recess shaped to house intake and exhaust camshafts shaped to actuate the intake and exhaust valves, respectively, and a ventilation arrangement molded to the cam cover and arranged above only the intake cam recess, and where the ventilation arrangement is fluidly coupled to a coolant line extending from an exhaust side of the cam cover to an intake side of the cam cover where the ventilation arrangement is arranged, and where the coolant line is fluidly coupled to a cylinder coolant jacket.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A liquid-cooled internal combustion engine comprising at least one cylinder head comprising at least one cylinder; an intake system shaped to supply air, the intake system comprising an inlet manifold laterally adjoining the at least one cylinder head and comprising a plenum chamber, from which at least one cylinder intake line branches off for each cylinder; and a liquid-type cooling arrangement comprises a cooling circuit equipped with a pump for conveying a coolant and with a ventilation vessel, the ventilation vessel is fluidly coupled to the cooling circuit of the internal combustion engine via a ventilation line and a return line, and the return line directly connects the ventilation vessel to a pump; wherein the ventilation vessel is arranged above the inlet manifold and between the inlet manifold and the at least one cylinder head, a virtual connecting line extending from the plenum chamber and the at least one cylinder head intersects the ventilation vessel.

2. The liquid-cooled internal combustion engine of claim 1, wherein the ventilation vessel is formed at least partially integrally with the inlet manifold.

3. The liquid-cooled internal combustion engine of claim 1, wherein the ventilation vessel is formed in one piece with the inlet manifold.

4. The liquid-cooled internal combustion engine of claim 1, wherein the ventilation vessel is formed at least partially integrally with a valve cover of the at least one cylinder head.

5. The liquid-cooled internal combustion engine of claim 1, wherein the cooling circuit is at least partially integrated into the at least one cylinder head.

6. The liquid-cooled internal combustion engine of claim 1, wherein the return line is at least partially integrated into the at least one cylinder head.

7. The liquid-cooled internal combustion engine of claim 6, wherein the pump is an electrically operated pump.

8. The liquid-cooled internal combustion engine of claim 6, wherein the pump is a mechanically operated pump.

9. The liquid-cooled internal combustion engine of claim 6, wherein the pump is driven via using a traction mechanism comprising a camshaft of the internal combustion engine.

10. The liquid-cooled internal combustion engine of claim 6, wherein the pump is fastened at an inlet side to the at least one cylinder head adjacent the intake manifold.

11. The liquid-cooled internal combustion engine of claim 1, wherein the ventilation vessel comprises a plastic material.

12. A system comprising: an engine comprising a cylinder head physically coupled to a cylinder block, the cylinder head comprising a valve cover coupled thereto, where a ventilation arrangement is integrated into the valve cover and arranged in a location between the intake manifold and the cylinder head, and the ventilation arrangement fluidly coupled to a cooling circuit; and a ventilation vessel of the ventilation arrangement arranged over an intake cam recess such that a longitudinal axis of the ventilation vessel is aligned with a longitudinal axis of the intake cam recess.

13. The system of claim 12, wherein the ventilation arrangement comprises the cooling circuit fluidly coupled to at least one coolant jacket of at least one cylinder of the engine, and where the valve cover is a cam cover, and where the cooling circuit extends around a portion of the cam cover from an exhaust side to an intake side where the ventilation arrangement is positioned.

14. The system of claim 13, wherein the cooling circuit extends through the cylinder head.

15. The system of claim 12, wherein the ventilation system comprises a pump arranged adjacent to the cylinder head.

16. The system of claim 15, wherein the pump is arranged interior to the cylinder head.

17. The system of claim 15, wherein the pump is fastened at an inlet side of the cylinder head.

18. The system of claim 15, wherein the pump is operated via a camshaft.

19. An engine comprising:

at least one cylinder arranged within a cylinder head and a cylinder block, the cylinder comprising one or more intake valves and exhaust valves;

a cam cover comprising an intake cam recess and an exhaust cam recess shaped to cover intake and exhaust camshafts shaped to actuate the intake and exhaust valves, respectively; and a ventilation arrangement integrally molded to the cam cover and arranged above only the intake cam recess, and where the ventilation arrangement is fluidly coupled to a coolant line extending from an exhaust side of the cam cover to an intake side of the cam cover where the ventilation arrangement is arranged, and where the coolant line is fluidly coupled to a cylinder coolant jacket.

* * * * *